US006159339A

United States Patent [19]

Hassler et al.

[11] Patent Number: 6,159,339

[45] Date of Patent: Dec. 12, 2000

[54] PAPER SIZE AND PAPER SIZING PROCESS

[75] Inventors: Thord G. Hassler, Jacksonville, Fla.; Jürgen F. Schuetz, Gelting, Germany; Bryan C. Smith, Raa, Sweden

[73] Assignee: BetzDearborn Inc., Trevose, Pa.

[21] Appl. No.: 09/125,525

[22] PCT Filed: Mar. 14, 1997

[86] PCT No.: PCT/EP97/01308

§ 371 Date: Aug. 19, 1998

§ 102(e) Date: Aug. 19, 1998

[87] PCT Pub. No.: WO97/35068

PCT Pub. Date: Sep. 25, 1997

[30] Foreign Application Priority Data

Mar. 21, 1996 [DE] Germany ..... 196 10 995

[51] Int. Cl.[7] ..... D21H 21/16

[52] U.S. Cl. ..... 162/158; 162/175; 162/179; 106/215.1; 106/215.2; 106/215.3; 106/215.4; 106/287.23; 106/287.24

[58] Field of Search ..... 162/158, 175, 162/179; 106/215.1, 215.2, 215.3, 215.4, 287.23, 287.24

[56] References Cited

U.S. PATENT DOCUMENTS

| | | | |
|---|---|---|---|
| 3,130,118 | 4/1964 | Chapman | 162/175 |
| 4,088,600 | 5/1978 | Tutein et al. . | |
| 4,522,686 | 6/1985 | Dumas . | |
| 4,859,244 | 8/1989 | Floyd . | |
| 4,861,376 | 8/1989 | Edwards et al. | 162/158 |
| 5,178,730 | 1/1993 | Bixler et al. | 162/168.3 |
| 5,595,631 | 1/1997 | Tsai et al. . | |
| 5,658,378 | 8/1997 | Tsai et al. . | |
| 5,766,417 | 6/1998 | Brungardt . | |

FOREIGN PATENT DOCUMENTS

| | | | |
|---|---|---|---|
| 0074544 | 8/1982 | European Pat. Off. . | |
| 0228576 | 3/1990 | European Pat. Off. . | |
| 0220941 | 1/1991 | European Pat. Off. . | |
| 2533411 | 7/1975 | Germany . | |
| 55-132799 | 10/1980 | Japan | 162/158 |
| 58-197397 | 11/1983 | Japan . | |
| 58-197397 | 5/1985 | Japan . | |
| 60-88196 | 5/1985 | Japan . | |
| 62-15397 | 1/1987 | Japan | 162/158 |
| 4289295 | 10/1992 | Japan . | |
| 4363301 | 12/1992 | Japan . | |
| 2252984 | 8/1992 | United Kingdom . | |
| 9310305 | 5/1993 | WIPO . | |
| 9737079 | 10/1997 | WIPO . | |

*Primary Examiner*—Peter Chin
*Attorney, Agent, or Firm*—Greenblum & Bernstein, P.L.C.

[57] ABSTRACT

Disclosed are a paper size consisting essentially of a) alkyl ketene dimer and/or alkenyl succinic acid anhydride; b) degraded, liquid cationic starch having a cationic charge density of 0.5 to 3.5 meqv/g, a degree of substitution of more than 0.1 and a viscosity of less than 10000 cps (30% by weight solution in water at 25° C.); and c) water, and a process for making paper products in which this paper size is added to the pulp. The invention allows the production of AKD and/or ASA sizes on-site in paper plants using simple mixing equipment.

13 Claims, No Drawings

PAPER SIZE AND PAPER SIZING PROCESS

The present invention relates to a paper size consisting essentially of an alkyl ketene dimer (AKD) and/or alkenyl succinic acid anhydride (ASA) sizing agent, a cationic starch emulsifier and water. Further the invention relates to a paper sizing process using a paper size which is essentially composed of an alkyl ketene dimer and/or alkenyl succinic acid anhydride sizing agent, a cationic starch emulsifier and water.

AKD and ASA sizes are widely used in the production of paper and cardboard. For good sizing efficiency it is required that the sizing agent is applied in the form of very small particles. Thus, AKD sizes are currently supplied to paper and cardboard manufacturers as fully formulated size dispersions or emulsions. However, such dispersions and emulsions have several disadavantages. For example, they often have to be transported over considerable distances to the paper plant which is uneconomical since such transport includes the transport of great amounts of water. Further, stability of AKD dispersions and emulsions is a problem. Accordingly such AKD size formulations include adjuvants like protective colloids, emulsifiers, surfactants etc. Such ingredients are not necessarily required for good sizing. To the contrary it is known that surfactants, particularly anionic surfactants, will not assist the deposition of AKD particles onto anionically charged fibers and will tend to reduce the performance of the sizing composition. Finally, during transport and storage the AKD may react with the aforementioned ingredients. Again this impairs the efficiency of the AKD size.

To avoid these disadvantages of AKD dispersions and emulsions it has already been proposed in the past to prepare the AKD sizing composition directly at the place of application, namely the paper plant. However, the problem is that emulsifying AKD is not easy and requires considerable know-how and expensive mixing equipment, namely high pressure homogenisers. It is not realistic and would be highly uneconomical to supply every paper plant with a high pressure homogeniser.

Therefore there have been several proposals in the past for economically feasible on-site processes for producing AKD and ASA sizes. However, it is not known that any of these proposals has gained commercial importance with regard to AKD sizes, while ASA sizes are mostly produced on-site.

DE-AS 25 33 411 includes a detailed discussion of the above outlined problems and discloses a process for sizing paper products using an aqueous emulsion containing AKD and an emulsifier selected from specific polyoxyalkylene-alkyl or polyoxyalkylenealkylaryl ethers or corresponding mono- or diesters. It is reported that emusification only requires stirring or passing the mixture through a mixing valve or an aspirator. It is even claimed that particularly selected mixtures can be used in sizing without a prior emulsification step.

Other proposals for on-site preparation of AKD and ASA sizes are disclosed in DE-OS 24 39 026, PCT-Application WO 94/13883, GB-A-2 252 984, EP-B-0 220 941 and EP-B-0 228 576.

It has now been surprisingly found that AKD and/or ASA sizes can be produced on-site at a paper plant in a simple manner by using a specific cationic starch emulsifier.

Thus the present invention relates to a paper size consisting essentially of a) alkyl ketene dimer and/or alkenyl succinic acid anhydride, b) degraded, liquid cationic starch having a cationic charge density of 0.5 to 3.5 meqv/g, a degree of substitution of more than 0.25 and a viscosity of less than 10000 cps (30% by weight solution in water at 25° C.), and c) water.

Further the invention relates to a process for making paper products in which a paper size is added to the pulp which is essentially, composed of a) alkyl ketene-dimer and/or alkenyl succinic acid anhydride, b) degraded, liquid cationic starch having a cationic charge density of 0.5 to 3.5 meqv/g, a degree of substitution of more than 0.25 and a viscosity of less than 10000 cps (30% by weight solution in water at 25° C.), and c) water.

Preferred embodiments of the present invention will become apparent from the following description and the claims.

Useful alkyl ketone dimers are those of the formula $(RCH{=}C{=}O)_2$ wherein R is selected from saturated or unsaturated alkyl radicals with at least eight carbon atoms, cycloalkyl radicals with at least six carbon atoms, aryl radicals, aralkyl radicals and alkaryl radicals or mixtures thereof (compare the definition of alkyl ketene dimers useful in paper sizing in the prior art, e.g. DE-AS 25 33 411 and DE-AS 23 35 756). Convenient are liquid AKDs in which R includes a high proportion of unsaturated $C_{16}$ radicals (derived from oleic acid) or short chain alkyl radicals, particularly $C_{12}$–$C_1$ radicals (derived from coconut fatty acids).

Useful alkenyl succinic acid anhydrides are those with a hydrocarbon radical having 7 to 30 and preferably 14 to 30 carbon atoms. Further it is preferable that said hydrocarbon radical is a saturated linear chain or branched radical.

The cationic starch emulsifier useful in the present invention is distinguished over cationic starches used in the prior art for preparing AKD and ASA emulsions in that it is a degraded, liquid cationic starch having a cationic charge density of 0.5 to 3.5 meqv/g, a degree of substitution of more than 0.25 and a viscosity of less than 10000 cps. The term "liquid starch" is used to cleary distinguish the cationic starches useful in the present invention over conventional cationic starches and designates an aqueous cationic starch solution which in contrast to A aqueous solutions of conventional cationic starches is liquid at a starch concentration of 30% by weight at room temperature or slightly above room temperature. Thus, the viscosity of the starch is determined for a 30% by weight solution in water at 25° C. using a Brookfield viscometer. It is important that the liquid starch has the stated viscosity at a concentration of 30% by weight since the concentration of the degraded, liquid cationic starch is around 30% by weight after preparation (see below). More preferred ranges for the degraded, liquid cationic starch are a cationic charge density of 1.0 to 2.0 meqv/g, a decree of substitution (D.S.) of 0.4 to 1.0, and a viscosity of less than 5000 cps, e.g. 2500 to 3500 cps.

The cationic starches useful in the present invention are quaternary ammonium alkyl ethers made for example by reacting starch under alkaline conditions with 2,3-epoxypropyltrimethyl-ammonium chloride. Such cationization of starches is well known in the art and for example disclosed in U.S. Pat. No. 4,088,600, the disclosure of which is included herein by reference (see also U.S. Pat. Nos. 2,876,217 and 4,840,705).

It is important that the starch is sufficiently degraded before, during or after cationization so that a liquid cationic starch exhibiting the required viscosity is obtained. Thus, the cationization can be carried out with an already degraded starch. Such starch is commerically available. Alternatively cationization can be carried out with non-degraded starch and thereafter sufficient acid (e.g. hydrochloric acid) is added to reduce the pH to about 0.5 to 1.0. The cationized starch is thus hydrolized and degraded. Once the required viscosity is obtained the pH is returned to neutral with e.g. caustic soda. Depending on the reaction conditions some degrading of the starch also takes place during the cationization stage. Therefore it is important to control the viscosity of the final degraded, liquid cationic starch so that it is within the above described ranges.

Any starch type is acceptable for preparing emulsifiers useful in the present invention but waxy maize, maize and potato starches are preferred.

The charge density of the useful cationic starches is determined in accordance with known methods based on the titration with the anionic polyelectrolyte PVSK (polyvinyl sulphate, potassium salt). Such titration can be carried out using commercial apparatus like the PCD-Titrator of Mutek Laser und opto-elektronische Geräte GmbH, Germany.

The degree of substitution (D.S.) of the highly degraded liquid cationic starch is also determined by the above titration with PVSK and thus relates to the actual degree of substitution of the starch molecules, while the D.S. values stated in the prior art mostly relate to theoretical values based on the assumption of complete reaction of the cationising agent with the starch.

In accordance with the present invention AKD and cationic starch emulsifier are used in weight ratios (based on solids contents) of 10:1 to 1:1, preferably 6:1 to 2:1 and most preferably 5:1 to 3:1. Very good results are obtained at a ratio of 8:3.

The AKD concentration in the paper size according to the present invention can be up to 25% by weight, 10 to 20% by weight being preferred. The corresponding concentration of the cationic starch emulsifier depends on the desired particle size in the final paper size formulation, higher concentrations resulting in improved particle size distributions. For example at a level of 20% by weight of AKD the concentration of the cationic starch emulsifier (based on solids content) is preferably about 10% by weight.

As mentioned above good sizing efficiency requires very small particle sizes of the AKD dispersion or emulsion. Accordingly particle sizes of 0.1 to 20 $\mu$m are suitable, particle sizes of 0.3 to 10 $\mu$m (e.g. a particle size distribution having a maximum below 3 $\mu$m) being preferred. The particle size measurement is carried out by laser light scattering using a MasterSizer apparatus of Malvern Instruments Ltd (for details compare MasterSizer E, Instrument Manual, Manual No. MAN 0060, Issue 1.0, May 1992; applicants have used the standard OHD refractive index model, see particularly Section 4.4).

The paper size according to the present invention is used in conventional amounts which crucially depend on the type of paper or board being produced. Usually amounts of up to 1.5 mg AKD/g paper are sufficient. Some papers (e.g. those with precipitated calcium carbonate filler) require significantly higher dosages of AKD.

When using ASA also very small particle sizes are required and conventional amounts are used. Thus, the above requirements outlined for AKD also apply to ASA.

Of course, besides the above described components conventional additives like alum, retention aids, antifoams, pH control agents etc. can be included. However, these are not essential with regard to the present invention.

The preparation of the paper size according to the present invention can be carried out continuously or batch-wise and does not require the use of high pressure homogenization apparatus. Thus custom built emulsification units can be used which are easy to handle and comparatively inexpensive. In case solid AKD is used, it is preferred that it is in the form of fine particles, e.g. flakes, prills, powder etc. First the cationic starch is mixed with water and the mixture is then heated to a suitable temperature (e.g. 60° C.). The AKD melt is then added to the starch solution under stirring with some kind of higher speed mixer (such as an Ultra Turrax). Stirring is continued until a homogeneous emulsion is obtained. When liquid AKD and/or ASA is used, mixing with the starch solution can take place at room temperature.

The cationic starch emulsifier useful in the present invention not only allows on-site preparation of AKD paper size, but also simplyfies on-site preparation of ASA paper size since it avoids the laborious on-site preparation of starch emulsifier based on conventional cationic starches. Further it is an advantage of the present invention that components which are all liquid can be used which facilitates handling and dosing. In addition liquid AKD and ASA are fully mixable so that they can be used in any desirable ratio. By using mixtures of AKD and ASA it is possible to make use of the advantages of these sizing agents but suppress or even eliminate their individual disadvantages. For example ASA usually provides a better particle size distribution than AKD. However, by including about 25% by weight ASA, based on the combined weight of AKD and ASA, a particle size distribution is achievable which is already quite similar to said obtained by using ASA alone. In case a mixture of AKD and ASA in a weight ratio of 1:1 is used, the achievable particle size distribution is practically identical with said obtainable by using ASA alone.

The formulations according to the present invention can be used alone or in combination with other sizing agents, e.g. emulsions or dispersions comprising AKD, ASA, rosin, isocyanates or other known sizing agents. Rosin sizes can be made using any known rosin, e.g. anionic rosin, cationic rosin, rosin soaps, fortified rosin and rosin esters or blends of these. The other sizing agents can be added to the pulp before, after or simultaneously with the sizing agent according to the present invention. They may also be pre-blended with the sizing agent of the present invention before addition to the pulp. Alternatively the other sizing agent can be added during the emulsification step when preparing the sizing agent of the present invention.

EXAMPLE 1

The following formulations (% by weight) were prepared:

| | (a) | (b) | (b*) | (c) | (e) | (f) |
|---|---|---|---|---|---|---|
| Stearic AKD | 20% | | | | | |
| Oleic AKD | | 20% | 10% | | | 10% |
| Coco AKD | | | | 20% | | |
| ASA | | | | | 20% | 10% |
| Cat. starch (based on solids content) | 5% | 5% | 2.5% | 5% | 5% | 5% |
| Water | 75% | 75% | 87.5% | 75% | 75% | 75% |

The cationic starch was a highly degraded, liquid cationic starch with a charge density of 1.32 meqv/g, a D.S. of 0.48 and a viscosity of 3500 cps at a concentration of 36.4% by weight.

In (a) the stearic AKD was broken into small pieces and then melted. The cationic starch was mixed with water and heated to about 60° C. The stearic AKD melt was then added to the starch solution and the mixture was emulsified for 30 seconds at 13.500 rpm in an Ultra Turrax.

In (b), (b*), (e) and (f) the oleic AKD and ASA were liquids and mixing took place as for (a) but at room temperature.

In (c) coco ($C_{12}$–$C_{18}$) AKD was heated slightly to melt it and then emulsified at room temperature as in (a).

All six samples were then used in identical sizing experiments. Hydrocol (cationic polyacrylamide and bentonite) was used as a retention aid. No fillers were used in these experiments. A standard commercial product (d) comprising ($C_{16}$–$C_{18}$) AKD, cationic starch having a D.S. of 0.08, an anionic additive and a small amount of alum, which is produced by high pressure homogenisation of AKD, starch and anionic additive in water using e.g. a Gaulin type homogeniser, was tested at the same dosage and under the same conditions for comparison.

At an AKD and/or ASA dosage of about 1.5 g per kg fibres in the pulp the following results were obtained.

| | Cobb 60 (g/m$^2$) |
|---|---|
| a) | 21.7, 19.9 |
| b) | 20.8, 22.3 |
| c) | 19.6, 20.5 |
| d) | 22.2, 22.1 |
| e) | 22.4, 19.5 |
| f) | 20.7, 20.5 |

Cobb 60 relates to the amount of water taken up by a unit area of paper in one minute. The lower the value, the better the sizing. Values of 25 or less indicate satisfactory sizing efficiency.

It can be seen that the sizing with the simple emulsions according to the present invention is as good or better than the standard commercial AKD size.

EXAMPLE 2

Formulations (a), (b*), (e) and (f) as well as standard commercial product (d) were also used in a sizing experiment to make paper containing about 15% by weight chalk filler. Results were as follows.

| | Dosage (g/kg fibres) | Cobb 60 (g/m$^2$) |
|---|---|---|
| a) | 1.5 | 17.6, 17.3 |
| b*) | 1.5 | 18.6 |
| d) | 1.6 | 20.4 |
| e) | 1.5 | 20.5, 23.3 |
| f) | 1.5 | 20.9, 21.0 |

These results confirm that the AKD and/or ASA emulsions of the present invention give sizing as good as or better than the standard commercial product at a dosage of 1.5 g/kg fibre in the pulp.

As demonstrated by the above examples the present invention allows simple on-site preparation of AKD and/or ASA size at a paper plant, avoids the disadvantages of fully formulated emulsions, particularly the adverse effects of surfactants included in such fully formulated emulsions, and combines the advantageous properties of cationic starch, i.e. the cationic starch serves as an emulsifier and at the same time aids retention. Particularly convenient is the preferred embodiment of the present invention in which only liquid components are used for size preparation. This allows easy handling and exact dosing with minimum apparatus requirements.

What is claimed is:

1. Paper size consisting essentially of a) at least one of alkyl ketene dimer and alkenyl succinic acid anhydride, b) degraded, liquid cationic starch having a cationic charge density of 0.5 to 3.5 meqv/g, a degree of substitution of more than 0.25 and a Brookfield viscosity of less than 10000 cps determined for a 30% by weight solution in water at 25° C., and c) water said cationic starch being present in an amount sufficient to emulsify said at least one of alkyl ketene dimer and alkenyl succinic acid anhydride.

2. Paper size according to claim 1 in which the degraded, liquid cationic starch has a cationic charge density of 1.0 to 2.0.

3. Paper size according to claim 2 in which the degraded, liquid cationic starch has a degree of substitution of 0.4 to 1.0.

4. Paper size according to claim 3 in which the degraded, liquid cationic starch has a viscosity of less than 5000 cps.

5. Paper size according to claim 4 in which the at least one of alkyl ketene dimer and alkenyl succinic acid anhydride comprises alkyl ketene dimer, and the alkyl ketene dimer is liquid.

6. Process for making paper products in which a paper size is added to the pulp which paper size is essentially composed of a) at least one of alkyl ketene dimer and alkenyl succinic acid anhydride, b) degraded, liquid cationic starch having a cationic charge density of 0.5 to 3.5 meqv/g, a degree of substitution of more than 0.25 and a Brookfield viscosity of less than 10000 cps determined for a 30% by weight solution in water at 25° C., and c) water said cationic starch being present in an amount sufficient to emulsify said at least one of alkyl ketene dimer and alkenyl succinic acid anhydride.

7. Process according to claim 6 in which degraded, liquid cationic starch is used having a cationic charge density of 1.0 to 2.0 meqv/g.

8. Process according to claim 7 in which degraded, liquid cationic starch is used having a degree of substitution of 0.4 to 1.0.

9. Process according to claim 8 in which degraded, liquid cationic starch is used having a viscosity of less than 5000 cps.

10. Process according to claim 9 in which liquid alkyl ketene dimer is used.

11. Process according to claim 10 in which before, after or simultaneously with the addition of the paper size also other sizing agents are added to the pulp.

12. Paper size according to claim 4 in which the degraded, liquid cationic starch has a viscosity in the range of 2500 to 3500 cps.

13. Process according to claim 9 in which degraded, liquid cationic starch is used having a viscosity in the range of 2500 to 3500 cps.

* * * * *

UNITED STATES PATENT AND TRADEMARK OFFICE

CERTIFICATE OF CORRECTION

PATENT NO. : 6,159,339
DATED : December 12, 2000
INVENTOR(S) : T. Hassler et al.

It is certified that error appears in the above-identified patent and that said Letters Patent is hereby corrected as shown below:

Title page,

Item [56], References Cited, U.S. PATENT DOCUMENTS, the following references were omitted and should be included:

| | | | |
|---|---|---|---|
| -- | 2,876,217 | 3/1959 | Paschall et al. |
| | 4,840,705 | 6/1989 | Ikeda et al. |
| | 5,578,169 | 11/1996 | Vihervaara -- |

Item [56], References Cited, FOREIGN PATENT DOCUMENTS, the following references were omitted and should be included:

| | | | |
|---|---|---|---|
| -- | AS-2335756 | 1/1974 | Germany |
| | OS-2335756 | 1/1974 | Germany |
| | OS-2439026 | 2/1975 | Germany |
| | 94/13883 | 6/1994 | W.I.P.O. -- |

Item [56], Refernces Cited, OTHER DOCUMENTS, the following references were omitted and should be included:

-- Patent Abstract of Japan, Vol. 017, No. 100 (C-1030) February 26, 1993, which is a family member of JP-A-4-289295, October 14, 1992.

Patent Abstract of JP 58-197397.

Patent Abstract of JP 4-363301.

Database WPI, Section Ch, Week 8401, Derwent Publications Ltd., London GB; Class A97, AN 84-002320, XP002036146, which is a family member of JP-A-58-197397, November 17, 1983. --

Database WPI, Section Ch, Week 9305, Derwent Publications Ltd., London GB; Class A11, AN 93-039372, XP002036147, which is a family member of JP-A-4-363301, December 16, 1992.

UNITED STATES PATENT AND TRADEMARK OFFICE

CERTIFICATE OF CORRECTION

PATENT NO. : 6,159,339
DATED : December 12, 2000
INVENTOR(S) : T. Hassler et al.

It is certified that error appears in the above-identified patent and that said Letters Patent is hereby corrected as shown below:

Title page (continued),
Item 56, References Cited, OTHER DOCUMENTS, the following references were omitted should be included:

-- English Language Abstract of JP-4-289295
English Language Abstract of JP-58-197397
English Language Abstract of JP-4-363301 --

Signed and Sealed this

Fourth Day of December, 2001

*Attest:*

Nicholas P. Godici

*Attesting Officer*

NICHOLAS P. GODICI
*Acting Director of the United States Patent and Trademark Office*